US008621700B2

(12) United States Patent
Wolf et al.

(10) Patent No.: US 8,621,700 B2
(45) Date of Patent: Jan. 7, 2014

(54) MOBILE SWEEPER

(75) Inventors: Hans-Peter Wolf, Gschwend (DE); Roland Schick, Auenwald (DE)

(73) Assignee: Alfred Kaercher GmbH & Co. KG, Winnenden (DE)

( * ) Notice: Subject to any disclaimer, the term of this patent is extended or adjusted under 35 U.S.C. 154(b) by 389 days.

(21) Appl. No.: 12/927,209

(22) Filed: Nov. 8, 2010

(65) Prior Publication Data

US 2011/0126367 A1 Jun. 2, 2011

Related U.S. Application Data

(63) Continuation of application No. PCT/EP2009/001839, filed on Mar. 13, 2009.

(30) Foreign Application Priority Data

May 14, 2008 (DE) ..... 10 2008 024 439

(51) Int. Cl.
*A47L 11/32* (2006.01)

(52) U.S. Cl.
USPC ..... 15/41.1; 15/21.1

(58) Field of Classification Search
USPC ..... 15/41.1, 42, 52.1, 79.1, 79.2, 83, 88.4
See application file for complete search history.

(56) References Cited

U.S. PATENT DOCUMENTS 984,336 A * 2/1911 Woodbury ..... 15/41.1
1,972,870 A 9/1934 Christesen
2,178,917 A 11/1939 Pullen
2,206,429 A 7/1940 Redfearn
2,235,432 A 3/1941 Kenyon
2,502,403 A 3/1950 Kircher
2,670,485 A 3/1954 Gomez
3,048,868 A 8/1962 Clark
3,101,498 A * 8/1963 Davlantes ..... 15/79.1

(Continued)

FOREIGN PATENT DOCUMENTS

DE 75 38 290 4/1976
DE 10 2006 037453 2/2008

(Continued)

OTHER PUBLICATIONS

*Patent Abstracts of Japan*, Abstract of Japanese Patent No. 03122309, "Power Travelling Sweeper", vol. 015, No. 325, Aug. 19, 1991.

*Primary Examiner* — Robert Scruggs
(74) *Attorney, Agent, or Firm* — Lipsitz & McAllister, LLC

(57) ABSTRACT

The invention relates to a mobile sweeper comprising a housing, in which a sweeping roller driven by an electric motor is mounted for rotation, and a sweepings container for receiving sweepings, wherein there are mounted on the housing adjacent to the sweeping roller two front supporting wheels and at a distance from these at least one rear supporting wheel, each for rotation about an axis of rotation. In order to further develop the sweeper such that with the occurrence of surface unevennesses, there is no risk of the sweeping roller becoming blocked or of the sweeper tilting, it is proposed in accordance with the invention that the axis of rotation of a first front supporting wheel be arranged coaxially with the axis of rotation of the sweeping roller and, in relation to the main direction of movement of the sweeper, offset from the axis of rotation of the second front supporting wheel.

12 Claims, 4 Drawing Sheets

(56) References Cited

U.S. PATENT DOCUMENTS

| | | | | |
|---|---|---|---|---|
| 3,196,473 | A | 7/1965 | Bell | |
| 4,155,610 | A | 5/1979 | Englund | |
| 4,263,689 | A | 4/1981 | Leibscher et al. | |
| 4,484,371 | A | 11/1984 | Pätzold et al. | |
| 4,709,436 | A | 12/1987 | Berfield et al. | |
| 5,224,232 | A | 7/1993 | Zahuranec et al. | |
| 6,553,600 | B2 | 4/2003 | Fischer | |
| 2002/0100130 | A1 | 8/2002 | Fischer | |
| 2004/0211444 | A1* | 10/2004 | Taylor et al. | 134/18 |
| 2005/0055785 | A1* | 3/2005 | Spooner | 15/41.1 |
| 2009/0077761 | A1* | 3/2009 | Kaleta et al. | 15/88.4 |

FOREIGN PATENT DOCUMENTS

| | | |
|---|---|---|
| EP | 1 199 971 | 5/2002 |
| EP | 1 707 679 | 10/2006 |
| EP | 1 816 265 | 8/2007 |
| GB | 2 134 777 | 8/1984 |
| GB | 2 252 036 | 7/1992 |
| JP | 03-122309 | 5/1991 |

* cited by examiner

MOBILE SWEEPER

This application is a continuation of international application number PCT/EP2009/001839 filed on Mar. 13, 2009 and claims the benefit of German application number 10 2008 024 439.2 filed on May 14, 2008.

The present disclosure relates to the subject matter disclosed in international application number PCT/EP2009/001839 of Mar. 13, 2009 and German application number 1 024 439.2 of May 14, 2008, which are incorporated herein by reference in their entirety and for all purposes.

BACKGROUND OF THE INVENTION

The invention relates to a mobile sweeper comprising a housing, in which a sweeping roller driven by an electric motor is mounted for rotation, and a sweepings container for receiving sweepings, wherein there are mounted on the housing adjacent to the sweeping roller two front supporting wheels and at a distance from these at least one rear supporting wheel, each for rotation about an axis of rotation.

Such sweepers are known, for example, from EP 1 199 971 B1. They can be moved along a surface to be cleaned, and sweepings can be picked up from the surface to be cleaned by the sweeping roller and transferred to the sweepings container.

Such sweepers have proven to be effective for cleaning inside surfaces of buildings. As a rule, good cleaning results are obtained on even surfaces. However, surfaces outside buildings can often only be cleaned insufficiently with such sweepers. This is due to the unevennesses which often occur. These not only make moving the sweepers difficult. There is also the risk that the sweeping roller will be blocked by unevennesses or the sweeper will accidentally tilt about an axis aligned transversely to the main direction of movement.

The object of the present invention is to so develop a sweeper of the kind mentioned at the outset that also when surface unevennesses occur there is no risk of the sweeping roller being blocked or of the sweeper tilting.

SUMMARY OF THE INVENTION

This object is accomplished, in accordance with the invention, with a mobile sweeper of the generic kind in that the axis of rotation of a first front supporting wheel is arranged coaxially with the axis of rotation of the sweeping roller and—in relation to the main direction of movement of the sweeper—offset from the axis of rotation of the second front supporting wheel.

In the sweeper in accordance with the invention, the axes of rotation of the two front supporting wheels are arranged offset from each other in relation to the main direction of movement of the sweeper. More specifically, the axis of rotation of a first front supporting wheel is aligned coaxially with the axis of rotation of the sweeping roller, and the axis of rotation of the second front supporting wheel is positioned offset therefrom. This makes it possible to choose at least for the first front supporting wheel a relatively large diameter, which facilitates the moving of the sweeper on uneven surfaces, without a large assembly space having to be provided for the supporting wheel in front of the sweeping roller. Such an assembly space would have the disadvantage that edge regions of a surface to be cleaned that are located at the front in the main direction of movement of the sweeper could not be reached by the sweeping roller. The arrangement of the axis of rotation of the first front supporting wheel coaxially with the axis of rotation of the sweeping roller has, in addition, the advantage that there is no risk of the sweeping roller being blocked by uneven ground since the first front supporting wheel arranged in alignment with the sweeping roller forms a kind of spacer for the sweeping roller by defining a definite distance between the axis of rotation of the sweeping roller and the surface to be cleaned. There is therefore practically no risk of the sweeping roller getting too close to the surface to be cleaned in the case of unevennesses and of the brushes of the sweeping roller then getting caught up on the ground. Also an increase in the sweeping resistance of the sweeping roller on account of unevennesses of the ground can be avoided. An increased sweeping resistance would result in a higher power consumption of an electric motor driving the sweeping roller and therefore in a heating and loading of the motor. Owing to the arrangement of the first front supporting wheel in alignment with the sweeping roller, the sweeping resistance of the sweeping roller can also be kept low on uneven ground.

The offset arrangement of the axes of rotation of the two supporting wheels makes it possible to choose a position in front of or behind the sweeping roller for the second front supporting wheel, so that a tilting of the sweeper can be counteracted. The arrangement of the second front supporting wheel offset from the sweeping roller has, in addition, the advantage that the end face of the sweeping roller that is oriented away from the first front supporting wheel can extend up to the outer edge of the housing or even beyond it. Therefore, side edge regions of a surface to be cleaned can also be reliably reached by the sweeping roller. The sweeper in accordance with the invention is therefore characterized by very good edge accessibility. For example, it is also possible to easily clean areas of ground immediately adjacent to a wall with the sweeping roller. The sweeping roller in accordance with the invention, consequently, enables sweeping close to the edge.

Preferably, the axis of rotation of the second front supporting wheel is arranged, in relation to the main direction of movement of the sweeper, behind the sweeping roller. This makes is possible to mount the sweeping roller at the front end of the housing.

Preferably, the second front supporting wheel is arranged immediately behind the sweeping roller. This increases the stability of the sweeper while moving it along an uneven surface.

Expediently, the diameter of the first front supporting wheel is larger than the diameter of the second front supporting wheel. As large a diameter as possible for the first front supporting wheel improves the handling characteristics of the sweeper. In contrast, a smaller diameter can be chosen for the second front supporting wheel arranged offset from the first front supporting wheel. This reduces the assembly space required for the second front supporting wheel without noticeably impairing the handling characteristics of the sweeper.

It may be provided that the diameter of the first front supporting wheel is at least 8 cm, preferably approximately 10 cm.

The diameter of the second front supporting wheel is less that approximately 7 cm in a preferred embodiment of the invention.

In an advantageous embodiment, the diameter of the first front supporting wheel is at least 1.3 times the diameter of the second front supporting wheel.

Preferably, the end face, oriented away from the first front supporting wheel, of the sweeping roller is arranged, transversely to the main direction of movement of the sweeper, level with the second front supporting wheel. It is particularly advantageous for the end face, oriented away from the first front supporting wheel, of the sweeping roller to project beyond the second front supporting wheel. Therefore, in a preferred embodiment of the invention, transversely to the main direction of movement of the sweeper, the second front supporting wheel is offset inwardly in the direction of the center axis of the sweeper. This enables sweeping particularly close to the edge as the brushes of the sweeping roller can extend laterally up to the edge of a floor surface to be cleaned without being obstructed by the second front supporting wheel.

As explained above, the sweeper in accordance with the invention comprises in addition to the two front supporting wheels at least one rear supporting wheel, which is mounted so as to rotate freely about an axis of rotation. In this case, it is expedient for the at least one rear supporting wheel to be mounted for rotation on a pivot support which is pivotable about a vertical pivot axis. The at least one rear supporting wheel therefore forms a steering wheel, which facilitates the moving of the sweeper along a surface, in particular, an uneven surface.

It is expedient for the sweeper to comprise two rear supporting wheels. This eliminates the risk of the sweeper tilting about its longitudinal axis while moving along a surface.

When two rear supporting wheels are used, it has proven particularly advantageous for the second front supporting wheel to be arranged, transversely to the main direction of movement of the sweeper, between a rear supporting wheel and the end face, oriented away from the first front supporting wheel, of the sweeping roller.

In an advantageous embodiment, the at least one rear supporting wheel has a smaller diameter than a front supporting wheel. In particular, it may be provided that the diameter of the at least one rear supporting wheel is smaller than the diameter of the second front supporting wheel.

The sweeping roller in the sweeper in accordance with the invention is driven by an electric motor. The electric motor can be supplied with power through a supply cable which is connectable to a voltage supply network or a generator. It is, however, particularly advantageous for the mobile sweeper to comprise at least one rechargeable battery. There is then no necessity for a voltage supply network or a generator to be accessible for operation of the sweeper. Use of a rechargeable battery, which is equipped with lithium-ion cells, has the particular advantage that the battery has practically no self-discharge. Therefore, even if the sweeper remains unused for a long time, it is not always necessary to first charge the battery. Lithium-ion cells also have the advantage that they are insensitive to cold and that they have a relatively low weight. In addition, they can be charged within a short time. Owing to the arrangement of the first front supporting wheel in alignment with the sweeping roller, its sweeping resistance, as explained above, can be kept low, even on uneven ground. There is therefore no necessity for high power consumption for the electric motors. This, in turn, extends the service life of the battery.

The following description of a preferred embodiment of the invention serves in conjunction with the drawings for further explanation.

DETAILED DESCRIPTION OF THE INVENTION

Figure 1:
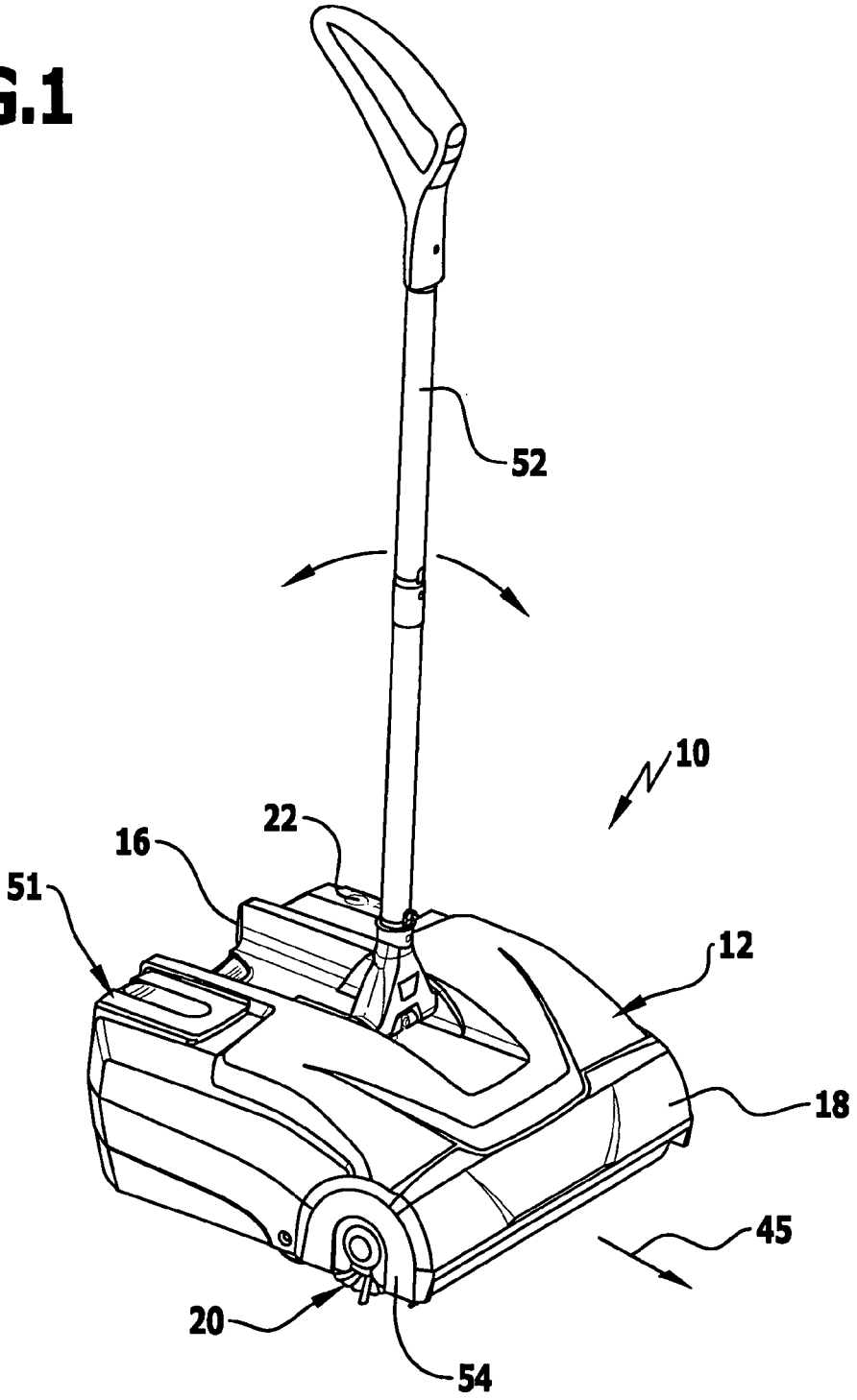
FIG. 1 shows a perspective representation of a mobile sweeper.

Schematically represented in the drawings is a preferred embodiment of a mobile sweeper 10 in accordance with the invention with a housing 12 surrounding a sweepings container 14. The sweepings container 14 is configured in the manner of a drawer and can be pulled out of the housing at the rear side 16 of the housing, emptied and then pushed back into the housing 12 again.

Immediately adjacent to the front side 18 of the housing 12, a sweeping roller 20 is mounted inside the housing for rotation about an axis of rotation 21. The sweeping roller 20 is set in rotation by an electric motor, which is known per se and, therefore, in order to achieve a better overview, is not shown in the drawings. The electric motor is arranged inside the housing 12 in a central region in front of an ON/OFF switch 22. The electric motor is in rotational connection with the sweeping roller via a belt drive 24. The belt drive 24 comprises, as usual, a belt pulley 26, which is rotationally fixedly held on a rotatably mounted drive shaft 28, and around which a drive belt 30 is led, which is driven by a two-stage belt transmission and a belt pulley (not shown in the drawings) coupled in a rotationally fixed manner to the motor shaft. The drive shaft 28 enters a lateral recess 34 of a roller core 36 of the sweeping roller 20 by means of a catch 32. The drive shaft 28 is rotationally fixedly connected by means of the catch 32 to the roller core 36, so that the latter can be set in rotation by the drive shaft 28. A multiplicity of brushes 38, with the aid of which a surface 40 can be cleaned, project radially outwards from the roller core 36.

The sweeper 10 has a total of four supporting wheels for moving it along the surface 40. A first front supporting wheel 41 is aligned with its axis of rotation 42 coaxially with the axis of rotation 21 of the sweeping roller 20. The first front supporting wheel 41 therefore acts as spacer for the sweeping roller 20 and prevents too great a sweeping resistance or even a blocking of the sweeping roller on uneven ground. The power consumption of the electric motor is thereby kept low, and this, in turn, increases the service life of the rechargeable battery 51, which supplies the electric motor with power.

A second front supporting wheel 44 is arranged, in relation to the main direction of movement 45 of the sweeper 10, rearwardly offset from the axis of rotation 21 of the sweeping roller 20 and therefore also offset from the axis of rotation 42 of the first front supporting wheel 41. The axis of rotation of the second front supporting wheel 44 is designated by reference numeral 46 in the drawings. Two rear supporting wheels 48, 49 are arranged at a distance from the front supporting wheels 41 and 44 in a rearward region of the housing 12. A first rear supporting wheel 48 is arranged below the ON/OFF switch 22, and the second rear supporting wheel 49 is arranged below the rechargeable battery 51. The battery 51 is equipped with lithium-ion cells which are characterized not only by a very high service life and by a relatively low weight but also by having practically no self-discharge and being insensitive to cold. The rechargeable battery 51 can be recharged within a very short time. In this connection, it may be provided that the battery 51 is removed from the housing 12 and connected to a separate charging station. It may, however, also be provided that the sweeper 10 has its own charging electronics, so that the battery 51 can be recharged inside the housing 12, provided the sweeper 10 is connected to a voltage supply network.

A shaft 52 is held for pivotal movement on the upper side of the housing 12. With the aid of this the sweeper 10 can be moved by the user along a surface 40 to be cleaned.

Figure 4:
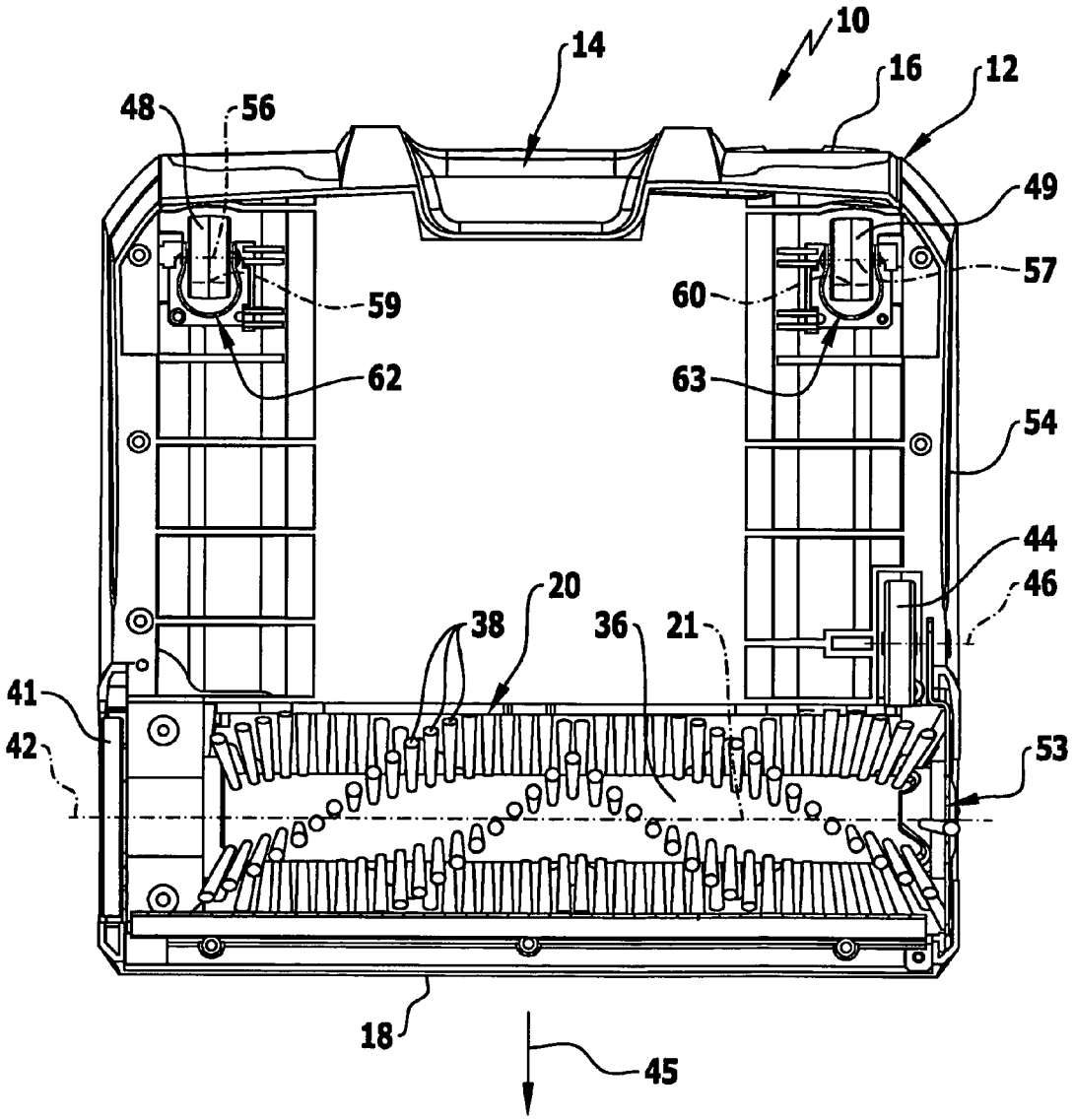
FIG. 4 shows a bottom view of the sweeper from FIG. 1.

As is apparent from FIG. 4, the sweeping roller 20 projects with its end face 53 that is oriented away from the first front supporting wheel 41 transversely to the main direction of movement 45 beyond the second front supporting wheel 44. The end face 53 is arranged on an outer wall 54 of the housing 12. As a result, an edge region of a surface to be cleaned can also be reached by the sweeping roller 20. For example, the sweeper 10 can be moved directly along a building wall delimiting a floor surface, with the sweeping roller 20 arranged at a very slight distance from the wall. From FIG. 4 it is apparent that the sweeping roller 20 extends right up to the front side 18 of the housing 12. It is therefore also possible, in the main direction of movement 45, to clean a surface up to a very short distance from a front wall. The sweeper 10 therefore has very good edge accessibility.

As is apparent, in particular, from FIG. 4, the diameter of the first supporting wheel 41 is chosen so as to be larger than the diameter of the second front supporting wheel 44. For example, the diameter of the first front supporting wheel 41 may be approximately 10 cm, whereas the diameter of the second front supporting wheel is preferably approximately 4 to 6 cm. The diameter of the two rear supporting wheels 48, 49 is chosen so as to be smaller than the diameter of the second front supporting wheel 44. For example, the rear supporting wheels may each have a diameter of approximately 4 cm.

The relatively large diameter of the first front supporting wheel 41 ensures that the sweeper 10 can also be reliably moved over uneven surfaces, i.e., uneven ground can be safely negotiated. At the same time, the arrangement of the first front supporting wheel 41 in alignment with the sweeping roller 20 ensures that the sweeping roller 20 maintains a constant distance from the surface 40 to be cleaned, even where uneven ground occurs. The risk of the sweeping roller 20 being blocked by unevennesses is therefore very slight.

To facilitate the moving of the sweeper 10 along the surface 40, the rear supporting wheels 48, 49 are configured as steering wheels, which are not only mounted for free rotation about an axis of rotation 56 and 57, respectively but can also be pivoted about a vertical pivot axis 59, 60. For this purpose, the rear supporting wheels 48, 49 are each mounted on a pivot support 62 and 63, respectively, which is pivotable about the respective vertical pivot axis 59 and 60, respectively.

Figure 2:
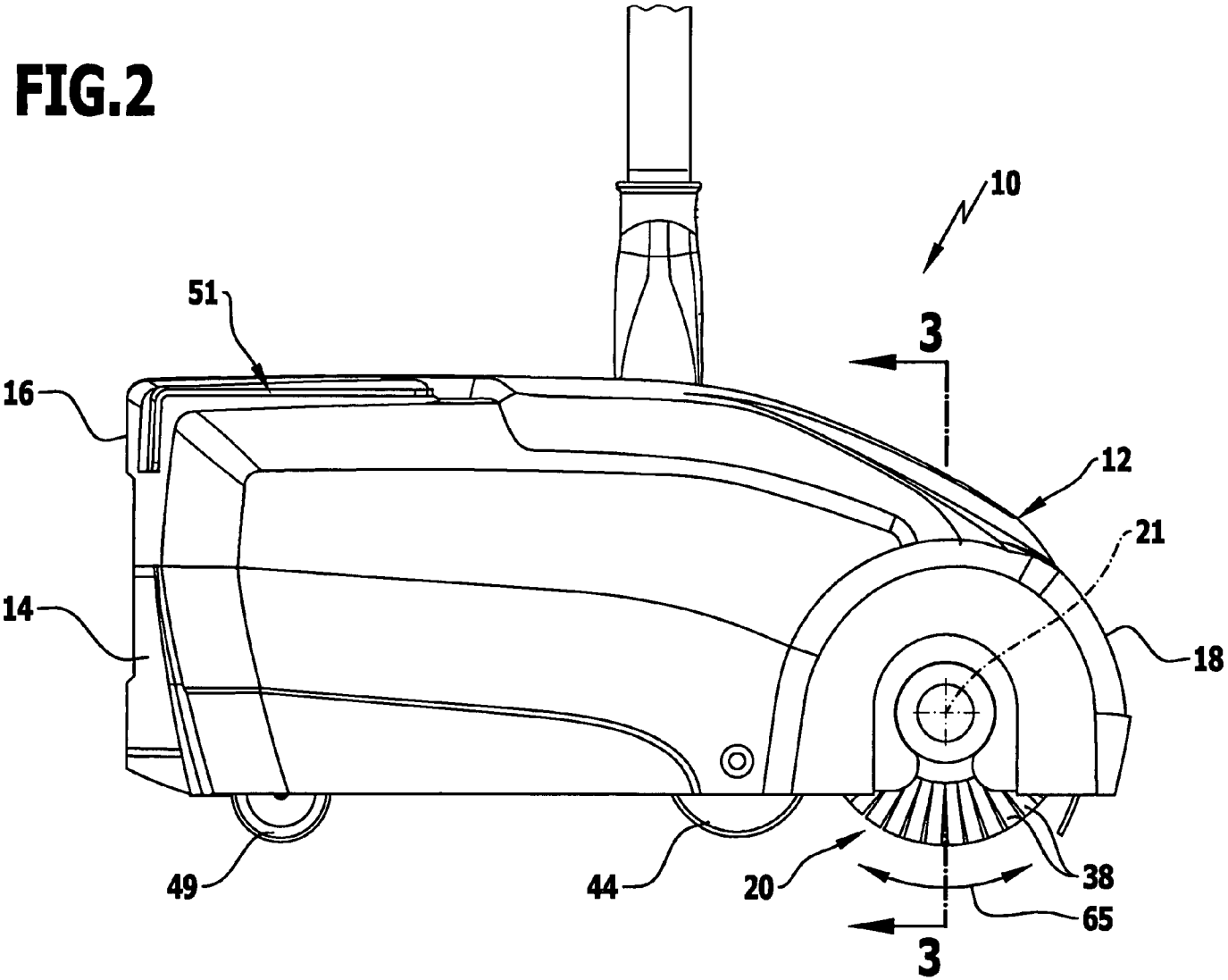
FIG. 2 shows a side view of the sweeper from FIG. 1.
Figure 3:
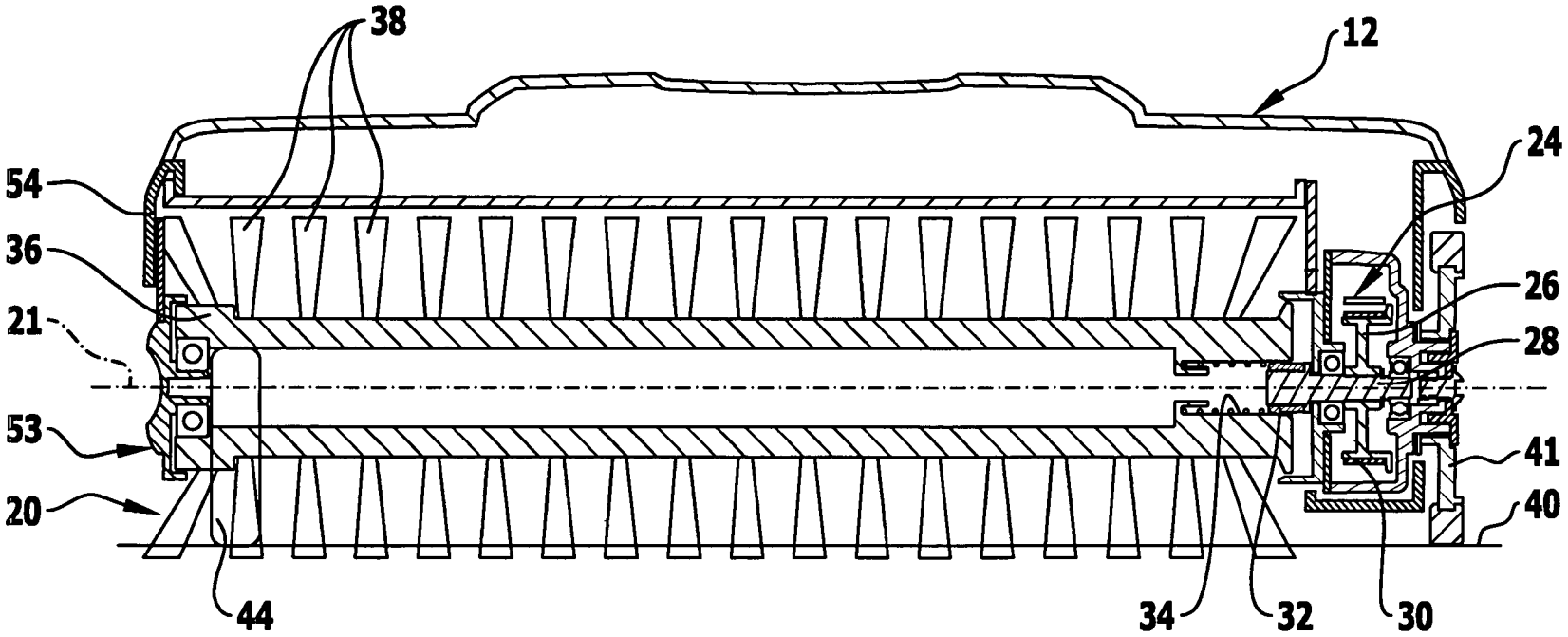
FIG. 3 shows a sectional view taken along line 3-3 in FIG. 2.

A surface 40 can be reliably cleaned using the sweeper 10. Sweepings are thereby picked up by the sweeping roller in accordance with the so-called throw-over principle from the surface 40 and transferred to the sweepings container 14. The direction of rotation of the sweeping roller 20 is chosen such that the brushes 38 contacting the surface 40 are moved parallel to the main direction of movement 45. This is symbolized by the arrow 65 in FIG. 2, which represents the direction of rotation of the sweeping roller 20. The sweepings are therefore thrown over the sweeping roller 20 into the adjoining sweepings container 14. It has been found that particularly good cleaning results are obtained by such a direction of rotation of the sweeping roller 20.

Owing to its good movability on uneven surfaces, too, the sweeper 10 is suited, in particular, for cleaning surfaces outside buildings. However, the sweeper 10 is not limited to this use. The inside surfaces of buildings can, of course, also be cleaned with the sweeper 10. Very good cleaning results are obtained with the sweeper 10 both outside and inside buildings.

The invention claimed is:

1. Mobile sweeper comprising:

a housing, a sweeping roller driven by an electric motor mounted for rotation in the housing; and a sweepings container for receiving sweepings;

wherein mounted on the housing adjacent to the sweeping roller are two frontmost supporting wheels disposed on opposite sides of the housing and at a distance from the two frontmost supporting wheels at least one rear supporting wheel, each for rotation about a respective axis of rotation; and wherein the axis of rotation of a first of the two frontmost supporting wheels is arranged coaxially with the axis of rotation of the sweeping roller and, in relation to a main direction of movement of the sweeper, is offset from the axis of rotation of the second of the two frontmost supporting wheels.

2. Sweeper in accordance with claim 1, wherein the axis of rotation of the second frontmost supporting wheel is arranged, in relation to the main direction of movement of the sweeper, behind the sweeping roller.

3. Sweeper in accordance with claim 2, wherein the second frontmost supporting wheel is arranged immediately behind the sweeping roller.

4. Sweeper in accordance with claim 1, wherein a diameter of the first frontmost supporting wheel is larger than a diameter of the second frontmost supporting wheel.

5. Sweeper in accordance with claim 1, wherein a diameter of the first frontmost supporting wheel is at least 8 cm.

6. Sweeper in accordance with claim 1, wherein a diameter of the first frontmost supporting wheel is at least 1.3 times a diameter of the second frontmost supporting wheel.

7. Sweeper in accordance with claim 1, wherein an end face of the sweeping roller, which is oriented away from the first frontmost supporting wheel, is arranged, in relation to a direction transversely to the main direction of movement of the sweeper, level with the second frontmost supporting wheel or projects beyond the second frontmost supporting wheel.

8. Sweeper in accordance with claim 1, wherein the at least one rear supporting wheel is mounted for rotation on a pivot support which is pivotable about a vertical pivot axis.

9. Sweeper in accordance with claim 1, wherein the at least one rear supporting wheel comprises two rear supporting wheels.

10. Sweeper in accordance with claim 1, wherein the at least one rear supporting wheel has a smaller diameter than at least one of the two frontmost supporting wheels.

11. Sweeper in accordance with claim 1, further comprising at least one rechargeable battery.

12. Sweeper in accordance with claim 11, wherein the rechargeable battery is equipped with lithium-ion cells.

* * * * *